US007232359B1

(12) United States Patent
Richardson

(10) Patent No.: US 7,232,359 B1
(45) Date of Patent: Jun. 19, 2007

(54) ADJUSTABLE BRA

(75) Inventor: Margaret A. Richardson, c/o Buchalter Nemer, 1000 Wilshire Blvd., Suite 1500, Los Angeles, CA (US) 90017

(73) Assignee: Margaret A. Richardson, Los Angeles, CA (US)

( * ) Notice: Subject to any disclaimer, the term of this patent is extended or adjusted under 35 U.S.C. 154(b) by 0 days.

(21) Appl. No.: 11/386,008

(22) Filed: Mar. 21, 2006

(51) Int. Cl.
*A41C 3/12* (2006.01)
*A41C 3/00* (2006.01)

(52) U.S. Cl. ..... 450/86; 450/88; 450/1; 450/58

(58) Field of Classification Search ..... 450/86, 450/88, 1, 92, 93, 58
See application file for complete search history.

(56) References Cited

U.S. PATENT DOCUMENTS

| | | | | |
|---|---|---|---|---|
| 5,149,293 | A | 9/1992 | Gable | |
| 5,378,192 | A | 1/1995 | Darmante | |
| 5,921,845 | A | 7/1999 | Scholtz | |
| 6,086,451 | A * | 7/2000 | Fernandes | 450/86 |
| 6,123,601 | A | 9/2000 | Hildebrandt | |
| 6,155,906 | A * | 12/2000 | May | 450/88 |
| 6,186,861 | B1 * | 2/2001 | Flaherty | 450/1 |
| 6,200,194 | B1 | 3/2001 | Grier | |
| 6,293,844 | B1 | 9/2001 | Dalton | |
| 6,302,761 | B1 | 10/2001 | Wrenn | |
| 6,306,005 | B1 * | 10/2001 | Archer | 450/47 |
| 6,309,489 | B1 | 10/2001 | Fildan et al. | |
| 6,321,422 | B1 * | 11/2001 | Fildan et al. | 24/537 |
| 6,336,839 | B1 | 1/2002 | Valli | |
| 6,357,444 | B1 | 3/2002 | Parker | |
| 6,390,884 | B1 | 5/2002 | Dragojevic | |
| 6,517,409 | B2 * | 2/2003 | Flaherty | 450/1 |
| 6,733,362 | B2 * | 5/2004 | Plew | 450/86 |
| 6,755,717 | B2 | 6/2004 | Smith | |
| 6,857,936 | B2 | 2/2005 | Jones et al. | |
| 6,916,224 | B2 | 7/2005 | Chen et al. | |
| 2003/0003844 | A1 | 1/2003 | Jones et al. | |
| 2003/0004448 | A1 | 1/2003 | Gregory | |
| 2004/0224607 | A1 | 11/2004 | Chen et al. | |

FOREIGN PATENT DOCUMENTS

| | | | |
|---|---|---|---|
| EP | 0 928 568 | A2 | 7/1999 |
| EP | 1 186 248 | A2 | 3/2002 |
| GB | 2 391 791 | A | 2/2004 |
| WO | WO 03/094642 | A1 | 11/2003 |

* cited by examiner

*Primary Examiner*—Gloria M. Hale
(74) *Attorney, Agent, or Firm*—Patrick Avakian; Buchalter Nemer

(57) ABSTRACT

The present invention is directed to an adjustable bra having first and second bra cups; one or more adjustable back bands connected to the respective bra cups; first and second detachable shoulder straps connected at one end to the respective bra cups and connected at the other end to the adjustable back band or bands; a removable or non-removable underwire in each bra cup that is shorter in length than standard underwire; and a plurality of shoulder strap fastener receiving elements incorporated along an entire length of the back band or bands, wherein the shoulder strap fastener receiving elements are adapted to receive and attach the first and second shoulder straps anywhere along the entire length of the back band or bands, including to both single and double layer back bands to enable a wearer to adjust the fit and comfort of the bra to a wearer's breast size and dimension.

20 Claims, 7 Drawing Sheets

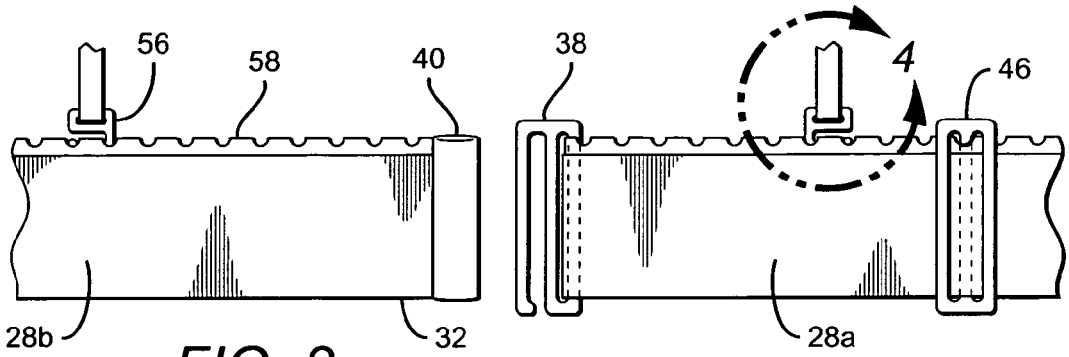
FIG. 3
FIG. 4
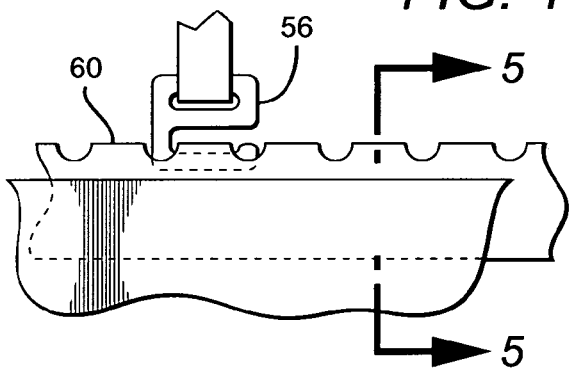
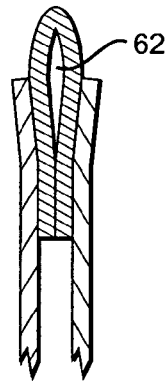
FIG. 5
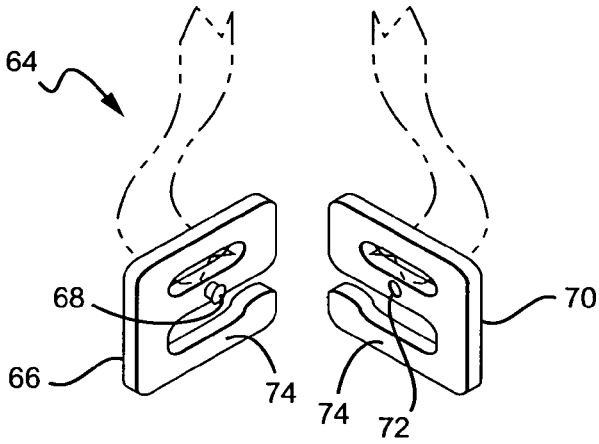
FIG. 6
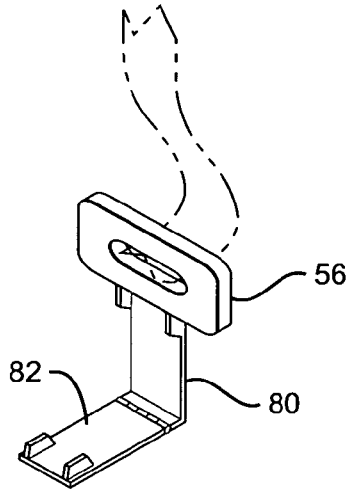
FIG. 11

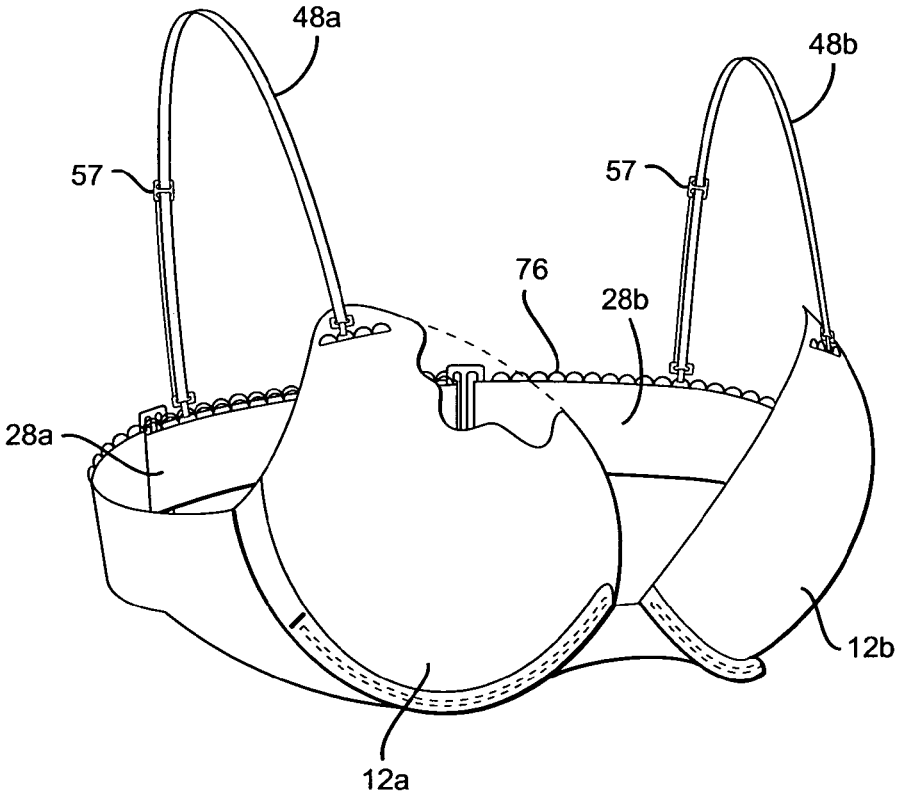
FIG. 7
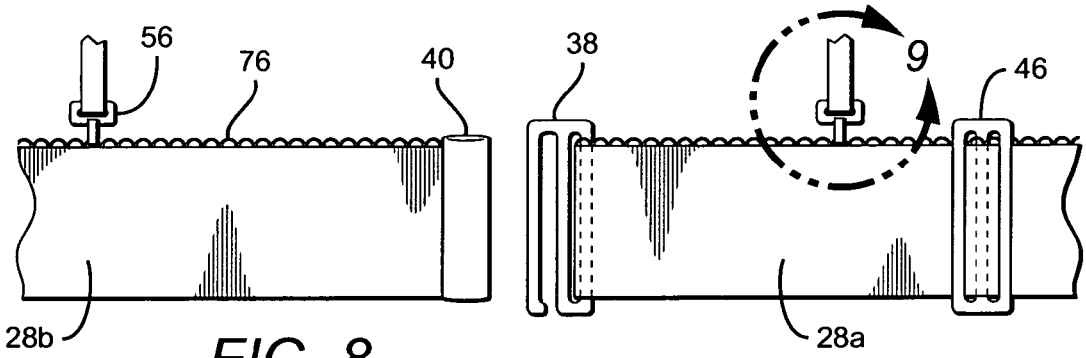
FIG. 8
FIG. 9
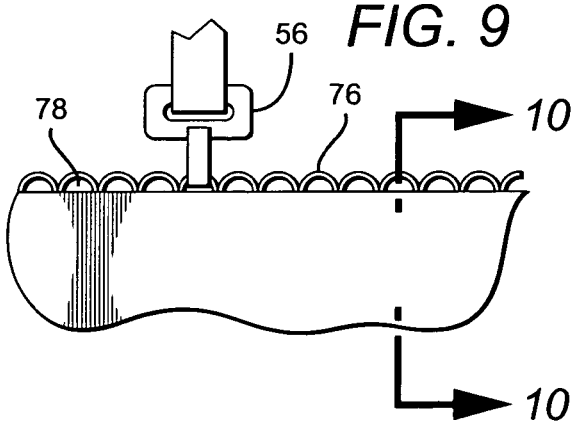
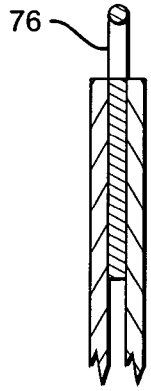
FIG. 10

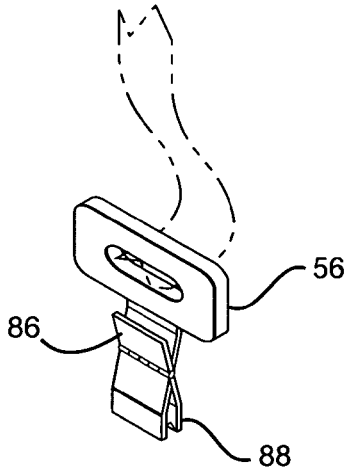
FIG. 16
FIG. 17
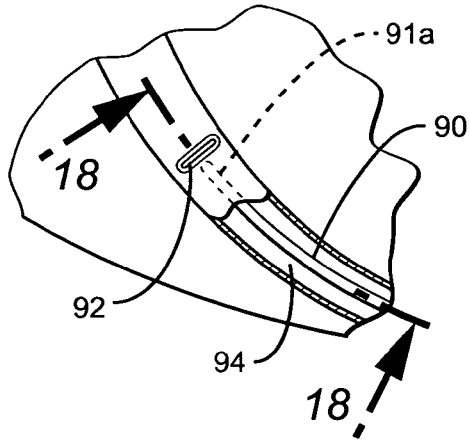
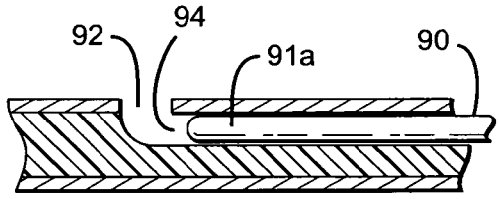
FIG. 18
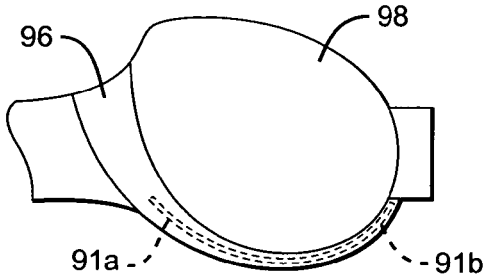
FIG. 19
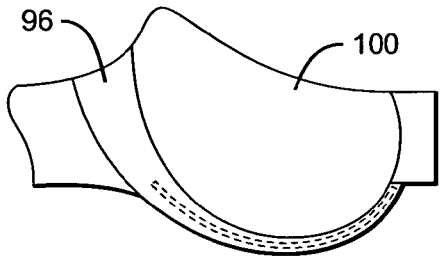
FIG. 20

ADJUSTABLE BRA

The subject matter described herein is directed to an adjustable bra. More particularly, the present invention is directed to a unique, novel, and nonobvious adjustable bra that allows a wearer to create a comfortable fit by providing a back band that is easily adjustable and that enables shoulder strap attachment anywhere and everywhere across the back band, and by providing various front or back closure elements, underwire that is shorter in length than standard underwire and that may be removable, and molded foam portions that form a foam frame.

BACKGROUND OF INVENTION

Most bras today are sold by bra band and bra cup size. It is cost prohibitive to manufacture every combination of band and cup size, so manufacturers and retailers offer only a limited selection of combinations, i.e., typically 34A-C, 36B-D, 38C-DD, 40 D-F. However, this limited size selection makes it difficult for women with different body types that do not fit this size selection to find a bra that fits comfortably. Moreover, this limited size selection does not take into account the body fluctuations of an individual woman that may result from day to day dieting and weight gain, cold and hot climates, and pregnancy and nursing. Many women wear the wrong bra size for their bodies, and this is likely a result of the lack of bra size combinations available and/or the limited flexibility within each bra to accommodate body changes or adjust to fabric changes after multiple uses. The problem with bra band and cup sizes is further exacerbated by the lack of a standard measurement, which particularly affects cup sizes, where the same letter cup changes dimension across band sizes and manufacturers.

Bras with adjustable back bands and interchangeable shoulder straps are known. However, known adjustable bras have back bands that provide only a limited number of adjustments, often two or three fixed locations, equating to approximately an inch of adjustment. This limited adjustment range may result in the wearer still having to endure improper fit, lack of proper support and discomfort when wearing such bras. Moreover, known adjustable bras have shoulder straps that are secured in fixed positions on the back band or are interchangeable but attach at fixed positions on the back band. Fixed straps cannot be replaced with other designs or better support, nor can the fixed straps be moved along the back band for a better fit. Interchangeable straps may be replaced but cannot be moved from the fixed attachment position on the back band. Many known bras do not allow for strap attachment anywhere across the back band, do not allow for attachment to double layer bands, and do not allow for multiple straps to be worn concurrently for fashion and functional purposes. In addition, many known adjustable bras include underwire within and along the entire bottom and sides of the bra cups. Underwire positioned along the sides of the bra cup, often close to the underarm, can be uncomfortable and constrictive and can put pressure on the sides of a woman's breasts. Only a few options exist for a woman who has concerns about underwire in her bra. She can remove the underwire from a bra that contains such underwire, often by having to cut it out from the bra. However, the bra then loses its structural integrity and no longer conforms to the body. She can also obtain a soft-cup or non-underwire bra. However, such bras provide less support and lift which a woman may need at the base of her breasts. Accordingly, there is a need for a new and improved adjustable bra that does not have the problems associated with known adjustable bras.

SUMMARY OF INVENTION

The present invention satisfies this need, as well as provides a unique and advantageous adjustable bra. None of the known adjustable bras provides all of the numerous advantages of the present invention. Unlike known adjustable bras, the adjustable bra of the present invention provides the following advantages: it is easy to use; it is inexpensive to manufacture; it provides for a back band or bands with numerous variations for adjustment along the back band or bands; it provides detachable shoulder straps of varying widths that can be attached anywhere along the back band or bands; it provides for shoulder strap attachment to both single and double-layered back bands; it provides for various front or back closure elements so that the bra can be closed in the back or in the front; it provides for removable underwire adapted to fit within the lower portion of the bra cups; it provides for a molded foam portion in the bra cups to form a foam frame for added support and comfort; it provides for an adjustable bra with shoulder straps that can be detached and used in conjunction with other apparel items of like material; it provides for an adjustable bra that can allow a manufacturer and retailer to offer numerous combinations of bra band and bra cup size with less monetary or space constraints and will allow a wearer to have a comfortable fit; it provides an adjustable bra with standardized cup sizes that does not vary across band size; it provides an adjustable bra that can benefit retailers selling the adjustable bra by providing lower inventory levels, higher sell-through percentages and a greater number of return customers; it provides for an adjustable bra that preferably offers only two band lengths per cup size which increases the number of sizes and combinations available; it provides an adjustable bra with an adjustable back band that offers an improved fit for women who fit between standard sizes or have disproportionate band to bust ratios (i.e., wide back/shallow front; narrow back/full front); it also offers an improved fit for a woman's changing bra needs for day and evening, weekday and weekend, dieting and weight gain, sensitive skin, hot climates, pregnancy, nursing, and other body changing conditions; it provides an adjustable bra having movable and removable shoulder straps with unique attachment means to enable attachment to single and double layer back bands; it provides an adjustable bra with front attachment means to allow a user to change the shape of the cup; and, it provides an adjustable bra with varying bra cup shapes.

In one embodiment, the adjustable bra of the present invention comprises: first and second bra cups connected together, wherein the first and second bra cups each include an underwire element adapted to fit within a lower portion of each of the first and second bra cups; a first adjustable back band having a first end connected to the first bra cup and having a second free end, and a second back band having a first end connected to the second bra cup and having a second free end, wherein the second free end of the first back band is detachably connected to the second free end of the second back band; at least one first detachable shoulder strap having a first end connected to the first bra cup and having a second end connected to the first back band, and at least one second detachable shoulder strap having a first end connected to the second bra cup and having a second end connected to the second back band; and, a plurality of shoulder strap fastener receiving elements incorporated along an entire length of the first and second back bands, wherein the shoulder strap fastener receiving elements are adapted to receive and attach the first and second shoulder straps anywhere along the entire length of the first and second back bands, including attachment to both a single layer back band and to a double layer back band, to enable a wearer to adjust the fit and comfort of the bra to a wearer's breast size and dimension.

In another embodiment, the adjustable bra of the present invention comprises: first and second bra cups having a detachable coupling between the bra cups, wherein the first and second bra cups each include an underwire element adapted to fit within a lower portion of each of the first and second bra cups; an adjustable back band having a first end attached to the first bra cup and having a second end attached to the second bra cup; at least one first detachable shoulder strap having a first end connected to the first bra cup and having a second end connected to a first portion of the back band, and at least one second detachable shoulder strap having a first end connected to the second bra cup and having a second end connected to a second portion of the back band; and, a plurality of shoulder strap fastener receiving elements incorporated along an entire length of the back band, wherein the shoulder strap fastener receiving elements are adapted to receive and attach the first and second shoulder straps anywhere along the entire length of the first and second back bands, including attachment to both a single layer back band and to a double layer back band, to enable a wearer to adjust the fit and comfort of the bra to a wearer's breast size and dimension.

Preferably, the shoulder strap fastener receiving elements may comprise loop trim with side openings, loop trim with front openings, ridged trim, or other suitable strap fastener receiving elements. The adjustable bra of the present invention may further comprise shoulder strap fasteners in the form of double hook elements, clasp elements, clamp elements, or other suitable shoulder strap fasteners. The adjustable bra of the present invention may further comprise removable underwire. The adjustable bra of the present invention may further comprise a molded foam portion formed in each of the first and second bra cups.

These and other features and advantages of the present invention will become better understood from the following description and appended claims.

BRIEF DESCRIPTION OF THE DRAWINGS

Exemplary embodiments of the present invention are shown in the drawings, in which:

FIG. 3 is a cut-away enlarged view of the exterior side of back band portions and strap fastener portions of the adjustable bra shown in FIG. 1;

FIG. 4 is a fragmentary view of circle 4 of FIG. 3. showing the strap fastener and portion of the strap fastener receiving elements in the form of loop trim with side openings;

FIG. 5 is a cross-sectional view taken along the lines 5-5 of FIG. 4;

FIG. 6 is an enlarged view of a first embodiment of a shoulder strap fastener in the form of a double hook element for use with the adjustable bra of the present invention;

FIG. 7 is a front perspective view of a second exemplary embodiment of the adjustable bra of the present invention showing back bands having loop trim with front openings and showing front and back shoulder strap fasteners;

FIG. 8 is a cut-away enlarged view of the exterior side of back band portions and strap fastener portions of the adjustable bra shown in FIG. 7;

FIG. 9 is a fragmentary view of circle 9 of FIG. 8. showing the strap fastener and portion of the strap fastener receiving elements in the form of loop trim with front openings;

FIG. 10 is a cross-sectional view taken along the lines 10-10 of FIG. 9;

FIG. 11 is an enlarged view of a second embodiment of a strap fastener element in the form of a clasp element for use with the adjustable bra of the present invention;

FIG. 16 is an enlarged view of a third embodiment of a strap fastener element in the form of a clamp element for use with the adjustable bra of the present invention;

FIG. 17 is a cut-away fragmentary view of circle 17 of FIG. 1 showing a removable underwire element of the adjustable bra of the present invention;

FIG. 18 is a cross-sectional view taken along the lines 18-18 of FIG. 17;

FIG. 19 is a first embodiment of a cup portion of the adjustable bra of the present invention showing a full cup;

FIG. 20 is a second embodiment of a cup portion of the adjustable bra of the present invention showing a demi cup;

DETAILED DESCRIPTION OF INVENTION

The present invention is directed to a unique, novel, and nonobvious adjustable bra that allows a wearer to create a comfortable fit by providing a back band or bands that are easily adjustable and that enable shoulder strap attachment anywhere and everywhere across the back band or bands, including to both single and double layer bands to enable a wearer to adjust the fit and comfort of the bra to a wearer's breast size and dimension. The bra of the present invention also provides various front or back closure elements, standardized cup sizes and molded foam portions that form a foam frame, and may have removable or non-removable underwire that is shorter in length than standard underwire.

Figure 1:
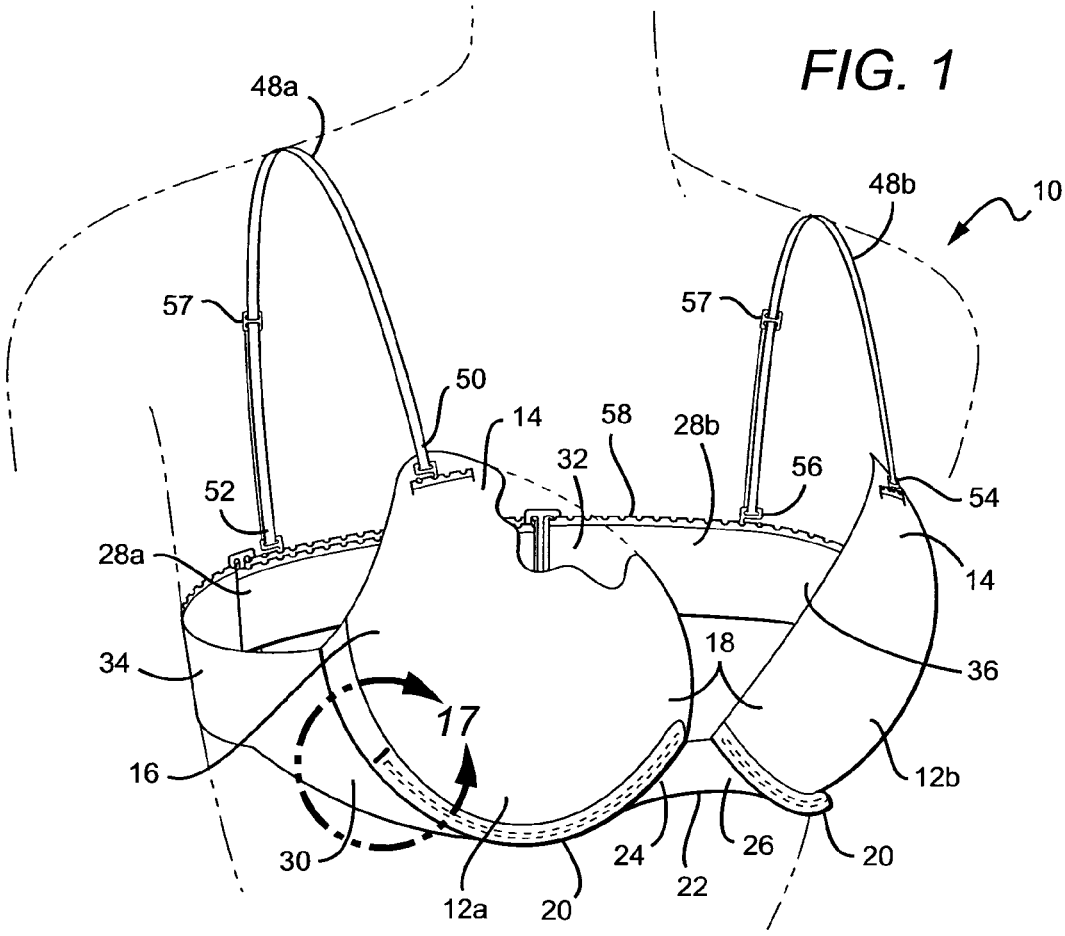
FIG. 1 is a front perspective view of a woman wearing a first exemplary embodiment of the adjustable bra of the present invention showing back bands having loop trim with side openings and showing front and back shoulder strap fasteners.
Figure 2:
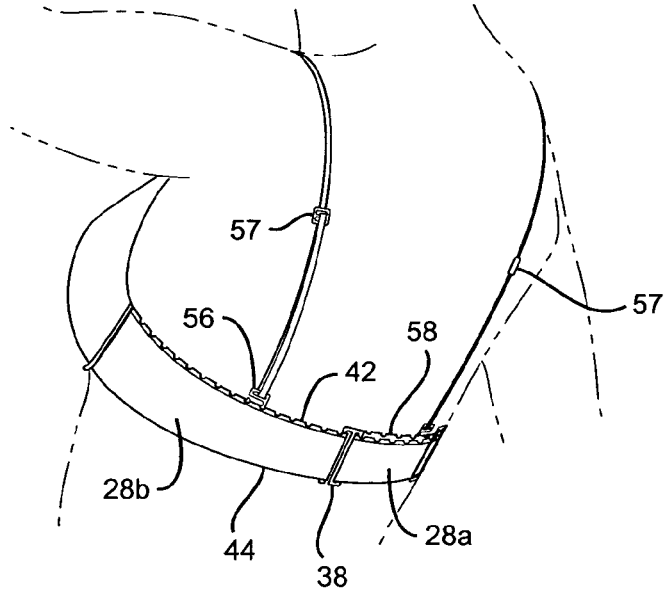
FIG. 2 is a rear perspective view of the adjustable bra of FIG. 1.

FIG. 1 is a front perspective view of a woman wearing a first exemplary embodiment of the adjustable bra of the present invention. In FIG. 1, adjustable bra 10 comprises a first bra cup 12*a* and a second bra cup 12*b*. Each bra cup 12*a*, 12*b* has an upper portion 14, an outer side portion 16, an inner side portion 18, and a lower portion 20. A front band element 22 has a first end 24 connected to the first bra cup 12*a* and a second end 26 connected to the second bra cup 12*b*. The front band element 22, as shown in FIG. 1, connects the first bra cup 12*a* to the second bra cup 12*b*. Preferably, the bra cups and front band element are made of woven or tricot knit fabric, foam, cotton, silk, polyester, microfiber, lycra, nylon, spandex, lace, satin, or other suitable materials. The adjustable bra 10 further comprises a first back band 28*a* and a second back band 28*b*, where the first back band is preferably adjustable. However, either the first back band, or the second back band, or both back bands may be adjustable. FIG. 2 is a rear perspective view of the adjustable bra of FIG. 1 showing the back bands. Each back band 28*a*, 28*b* has a first end 30 coupled to the outer side portions 16 of the first and second bra cups 12*a*, 12*b* and each back band 28*a*, 28*b* has a second free end 32. Further, each back band has an exterior side 34 and an interior side 36. FIG. 3 is a cut-away enlarged view of the exterior side of the back band portions of the adjustable bra shown in FIG. 1. Preferably, the back bands are made of woven or tricot knit fabric, foam, cotton, silk, polyester, microfiber, lycra, nylon, spandex, lace, satin, or other suitable materials. As shown in FIG. 3, the second end 32 of back band 28*a* has a back closure element 38. The back closure element 38 may be attached to the second end of either back band 28*a* or back band 28*b*. Preferably, the back closure element 38 is a vertically oriented structure in the form of a hook element that is incorporated into an end seam of the second end 32. However, a horizontally oriented structure in the form of a hook element may also be used. Other suitable back closure elements, such as snaps, clasps, clamps, buttons, rings, ties, zippers, or clips may also be used. As shown in FIG. 3, the second end 32 of back band 28*b* has a back closure receiving element 40. The back closure receiving element 40 may be formed in the second end of either back band 28*b* or back band 28*a*, just so that it is opposite the back closure element 38. Preferably, the back closure receiving element 40 is a vertically oriented loop adapted for receiving the back closure element 38, preferably in the form of a hook element, and adapted for fastening the respective first and second back bands 28*a*, 28*b* together. The first and second back bands 28*a*, 28*b* are thus detachably connected. Other suitable back closure receiving elements, such as horizontal loop receiving elements, snap receiving elements, clasp receiving elements, clamp receiving elements, buttonholes, ring receiving elements, ties, zippers, or clip receiving elements may also be used. As shown in FIG. 1, when the back closure element 38 is coupled to the back closure receiving element 40, the first and second back bands 28*a*, 28*b* are connected and extend around the torso and back of a wearer. Preferably, the back closure and back closure receiving element are made of plastic, metal, rubber or other suitable materials. The first and second back bands 28*a*, 28*b* each further include a top end 42 and a bottom end 44. As shown in FIG. 3, back band 28*a* may further include a band adjustor element 46 attached to back band 28*a* for adjusting the length of back band 28*a*. The back band adjustor element 46 may be attached to either back band 28*a* or back band 28*b* or to both back bands 28*a*, 28*b*. Preferably, the back band adjustor element is made of plastic, metal, rubber or other suitable materials. The adjustable bra of the present invention preferably offers two band lengths per cup size which increases the number of sizes and combinations available. The two band lengths per cup size equate to approximately 10 bands typically produced for sizes 28-46.

The adjustable bra 10 of the present invention further comprises at least one first detachable and adjustable shoulder strap 48*a* and at least one second detachable and adjustable shoulder strap 48*b*. Each shoulder strap 48*a*, 48*b* has a first end 50 and a second end 52. Preferably, the shoulder straps are made of woven or tricot knit fabric, foam, cotton, silk, polyester, microfiber, lycra, nylon, spandex, lace, satin, plastic (for example, clear plastic straps) or other suitable materials. Preferably, the first end 50 of each shoulder strap 48*a*, 48*b* is connected respectively to the upper portions 14 of first and second bra cups 12*a*, 12*b* via a detachable front shoulder strap fastener 54. Preferably, the front shoulder strap fastener 54 comprises, as discussed in more detail below, a double hook element, a clasp element, a clamp element, or another suitable strap fastener. Preferably, the second end 52 of each shoulder strap 48*a*, 48*b* is connected respectively to the top end 42 of the first and second back bands 28*a*, 28*b* via a detachable back shoulder strap fastener 56. Preferably, the back shoulder strap fastener 56 comprises, as discussed in more detail below, a double hook element, a clasp element, a clamp element, or another suitable strap fastener. Further, each shoulder strap 48*a*, 48*b* may further include a strap adjustor element 57 attached to each shoulder strap 48*a*, 48*b* for adjusting the length of each shoulder strap 48*a*, 48*b*. Preferably, the strap adjustor element is made of plastic, metal, rubber or other suitable materials. Shoulder straps 48*a*, 48*b* should be of a suitable width to comfortably distribute the weight of a woman's breasts over the shoulders without cutting into the woman's skin.

In addition, the shoulder straps used with the adjustable bra of the present invention may be convertible and interchangeable among various tops. The garment of the present invention is preferably in the form of a bra but is not limited to this form of intimate apparel. The shoulder straps 48*a*, 48*b* may be convertible and interchangeable among bras, maternity/nursing bras, camisoles, chemises, slips, and other intimate apparel where the shoulder straps are made of a like or suitable material of such apparel. The shoulder straps may also be made of swimwear material and interchangeable with other swimwear.

The adjustable bra 10 of the present invention further comprises a plurality of shoulder strap fastener receiving elements 58. The strap fastener receiving elements 58 are preferably incorporated along the entire top end 42 of the first and second back bands 28*a*, 28*b*, such that the second end 52 of first and second shoulder straps 48*a*, 48*b* can be attached to the first and second back bands 28*a*, 28*b* anywhere along the top end 42 of the first and second back bands 28*a*, 28*b*, including attachment to both a single layer back band and to a double layer back band, to enable the wearer to adjust the fit and comfort of the bra to a wearer's breast size and dimension. In addition, the strap fastener receiving elements 58 may be incorporated along the upper portion 14 of bra cups 12*a*, 12*b*, such that the first end 50 of first and second shoulder straps 48*a*, 48*b* can be attached to the first and second bra cups 12*a*, 12*b* along the upper portion 14 of bra cups 12*a*, 12*b*. Preferably, the strap fastener receiving elements are made of woven or tricot knit fabric, foam, cotton, silk, polyester, microfiber, lycra, nylon, spandex, lace, satin or other suitable materials.

In a first exemplary embodiment, as shown in FIGS. 1-5, the shoulder strap fastener receiving elements 58 comprise a loop trim 60 with side openings 62. The loop trim 60 with side openings 62 may be placed above or below the top end 42 of back bands 28*a*, 28*b*. FIG. 1 shows back bands having loop trim with side openings and shows front and back shoulder strap fasteners. FIG. 4 is a fragmentary view of circle 4 of FIG. 3. showing the loop trim with side openings. FIG. 5 is a cross-sectional view taken along the lines 5-5 of FIG. 4 showing the side opening 62 of the loop trim. Preferably, the back shoulder strap fastener 56 used with this first embodiment is in the form of a double hook element 64, as shown in FIG. 6. The double hook element is preferably only used for attachment of the shoulder strap to the back band or bands. A single hook element in the same shape and configuration as a half portion of the double hook element is preferably used for attachment of the shoulder strap to the first and second bra cups. FIG. 6 is an enlarged view of a first embodiment of a shoulder strap fastener in the form of a double hook element for use with the adjustable bra of the present invention. The double hook element 64 has a first hook element 66 with a male snap portion 68 and a corresponding second hook element 70 with a female snap receiving opening 72. Preferably, the double hook element is made of plastic, metal, rubber or other suitable materials. The double hook element 64 with first and second elements 66, 70 accommodates single and double-layered back bands and snaps together to give the appearance of a single hook. When coupled or snapped together, the lower portion 74 of the double hook element 64 can be inserted into one or more side openings 62 of the loop trim 60 and gives the wearer the option of fastening the shoulder straps 48*a*, 48*b* anywhere along the top end 42 of the back bands 28*a*, 28*b*. For double layered back bands, the double hook element 64 is separated into the first hook element 66 and the second hook element 70, each hook element 66, 70 is inserted through each respective back band layer of the double layered back band, and then hook elements 66, 70 are coupled or snapped together to give the appearance of a single hook. The double hook elements may be of varying suitable widths to accommodate narrow to wide shoulder straps. In addition, the double hook elements may be of a suitable dimension to be inserted through single or double-layered loop trim side openings on the back bands to form a side to side attachment of the shoulder straps.

In a second exemplary embodiment, as shown in FIGS. 7-11, the shoulder strap fastener receiving elements 58 comprise a loop trim 76 with front openings 78, wherein the front openings are preferably in the shape of arches. The loop trim 76 with front openings 78 may be placed above or below the top end 42 of back bands 28*a*, 28*b*. FIG. 7 is a front perspective view of a second exemplary embodiment of the adjustable bra of the present invention showing back bands having the loop trim with front openings and showing front and back shoulder strap fasteners. FIG. 8 is a cut-away enlarged view of the exterior side of back band portions and strap fastener portions of the adjustable bra shown in FIG. 7. FIG. 9 is a fragmentary view of circle 9 of FIG. 8. showing the loop trim with front openings. FIG. 10 is a cross-sectional view taken along the lines 10-10 of FIG. 9 showing the front openings 78 of the loop trim 76. Preferably, the back shoulder strap fastener 56 used with this second embodiment is in the form of a clasp element 80, as shown in FIG. 11. FIG. 11 is an enlarged view of a second embodiment of a shoulder strap fastener in the form of a clasp element for use with the adjustable bra of the present invention. The clasp element 80 has a lower hinged portion 82 that can be inserted through any front opening 78 of the loop trim 76 and clasped shut to fasten the shoulder straps 48*a*, 48*b* anywhere along the top end 42 of the back bands 28*a*, 28*b*. Preferably, the clasp element is made of plastic, metal, rubber or other suitable materials. The clasp element may be used singly or in multiples to provide a suitable width to accommodate narrow to wide shoulder straps. In addition, the clasp element may be of a suitable dimension to be inserted through single or double-layered loop trim on the back bands to form a back to front attachment of the shoulder straps.

Figure 12:
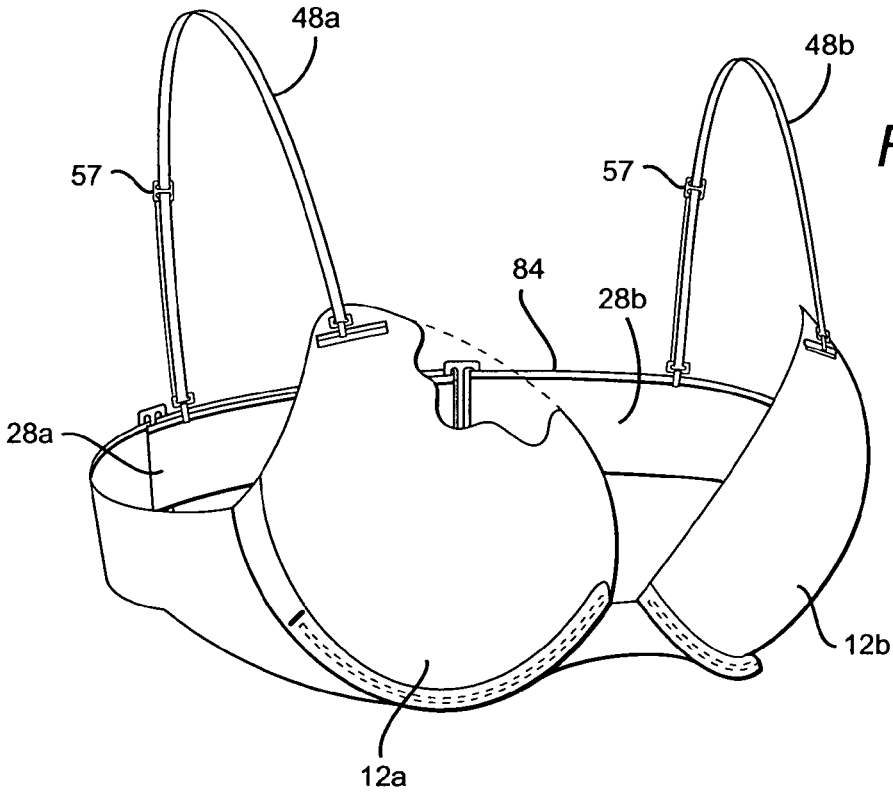
FIG. 12 is a front perspective view of a third exemplary embodiment of the adjustable bra of the present invention showing back bands with ridged trim and showing front and back shoulder strap fasteners.
Figure 13:
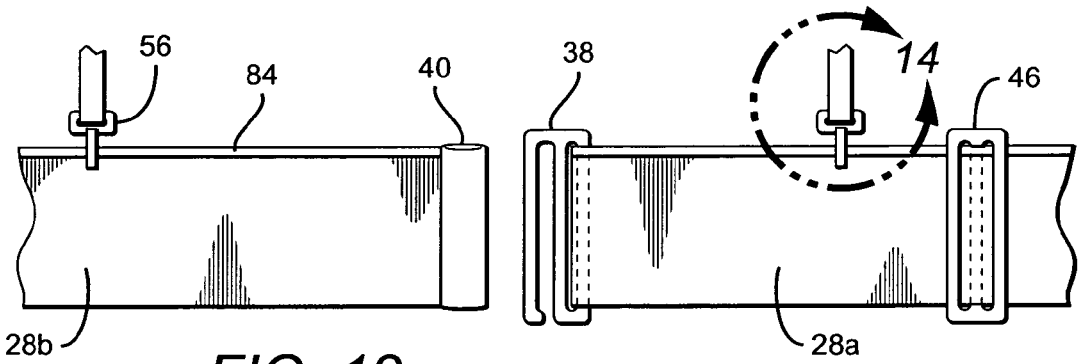
FIG. 13 is a cut-away enlarged view of the exterior side of the back band portion and strap fastener portions of the adjustable bra shown in FIG. 12.
Figure 14:
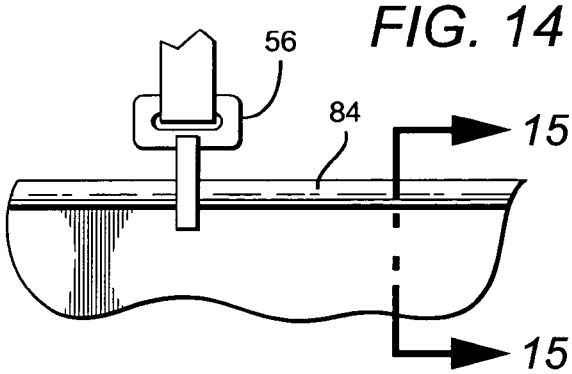
FIG. 14 is a fragmentary view of circle 14 of FIG. 13 showing the strap fastener and portion of the strap fastener receiving elements in the form of ridged trim.
Figure 15:
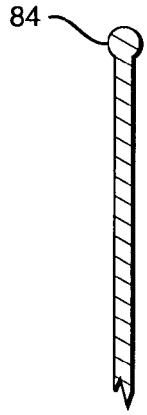
FIG. 15 is a cross-sectional view taken along the lines 15-15 of FIG. 14.

In a third exemplary embodiment, as shown in FIGS. 12-16, the shoulder strap fastener receiving elements 58 comprise a ridged trim 84 with no openings. FIG. 12 is a front perspective view of a third exemplary embodiment of the adjustable bra of the present invention showing back bands with ridged trim and showing front and back shoulder strap fasteners. FIG. 13 is a cut-away enlarged view of the exterior side of the back band portion and strap fastener portions of the adjustable bra shown in FIG. 12. FIG. 14 is a fragmentary view of circle 14 of FIG. 13. showing the ridged trim 76. FIG. 15 is a cross-sectional view taken along the lines 15-15 of FIG. 14 showing the ridged trim 84. Preferably, the back shoulder strap fastener 56 used with this third embodiment is in the form of a clamp element 86, as shown in FIG. 16. FIG. 16 is an enlarged view of a third embodiment of a strap fastener element in the form of a clamp element for use with the adjustable bra of the present invention. The clamp element 86 has a lower jaw portion 88 that can be opened around the ridged trim 84 and clamped shut to fasten the shoulder straps 48*a*, 48*b* anywhere along the top end 42 of the back bands 28*a*, 28*b*. The lower jaw portion 88 of the clamp element 86 attaches at the base of the ridged trim and grips the base of the ridged trim to prevent separation. Preferably, the clamp element is made of plastic, metal, rubber or other suitable materials. The clamp element may be of varying suitable widths to accommodate narrow to wide shoulder straps. In addition, the clamp element may be of a suitable dimension to attach the shoulder straps to both single and double-layered back bands.

As specifically shown in FIGS. 17-18, the adjustable bra 10 of the present invention further comprises an underwire element 90 having a first end 91*a* and a second end 91*b*, wherein the underwire element 90 is adapted to fit within the lower portion 20 of the first and second bra cups 12*a*, 12*b*. FIG. 17 is a cut-away fragmentary view of circle 17 of FIG. 1 showing the removable underwire element of the adjustable bra of the present invention. FIG. 18 is a cross-sectional view taken along the lines 18-18 of FIG. 17. In conventional bras having underwire, the underwire typically extends along the entire outer sides and lower portions of the bras. The underwire used in the adjustable bra of the present invention is of a shorter length than the typical size of underwire used in known bras. Preferably, the underwire used in the adjustable bra of the present invention is approximately half the length of standard underwire used in known bras. Preferably, the underwire used with the adjustable bra of the present invention is slightly arcuate in shape and is of a suitable length and thickness so it can easily fit within the lower portion of each bra cup. Preferably, the underwire used with the adjustable bra of the present invention is made of aluminum metal, plastic, rubber or other suitable materials. The underwire is of a suitable size to provide support and lift directly under a woman's breasts without extending upwardly and putting pressure on the sides of a woman's breasts. The underwire may either be removable or may not be removable. Where the adjustable bra of the present invention has removable underwire, the removable underwire, as shown in FIG. 17, is inserted and removed through an opening 92 in the bra cup 12*a*, 12*b* and fits within a channel 94 within the bra cup 12*a*, 12*b*. The opening may preferably be in the form of a buttonhole, circular hole, slot or slit. As shown in FIG. 1, when the underwire is in place in each bra cup, the first end 91*a* of the underwire terminates at the interior inner side of each bra cup, and the second end 91*b* of the underwire terminates at the opening 92. The first and second ends of the underwire may be flattened in a manner to avoid sharp edges to prevent discomfort to a wearer. The underwire may be removable to give women options without deconstructing the bra. The ends of the removable underwire may also be covered in foam and/or connected to a piece of material or ribbon (not shown) to facilitate removal of the underwire from the bra cup. In one embodiment of the present invention, the adjustable bra comprises first and second bra cups each having a removable underwire element adapted to fit within the lower portion of each of the first and second bra cups, such that the underwire has a first end and a second end, where the first end is adjacent an interior inner side of each bra cup and where the second end is adjacent an opening in the lower portion of each bra cup, and further wherein the underwire may be removed through the opening in each bra cup. In another embodiment of the present invention, the adjustable bra comprises first and second bra cups connected together, wherein the first and second bra cups each have an upper portion, a lower portion, an inner portion and an outer portion, and further wherein the first and second bra cups each include an underwire element adapted to fit within the lower portion of each of the first and second bra cups, such that the underwire has a first end and a second end, where the first end is adjacent an interior inner side of each bra cup and where the second end is adjacent an interior lower portion of each bra cup. This version does not have an opening to remove the underwire, and the underwire is sewn within the lower portion of each bra cup.

Moreover, the adjustable bra of the present invention may comprise a molded foam portion 96 for reinforcement and support. As shown in FIGS. 19 and 20, the foam portion 96 is formed as part of each of the first and second bra cups. The molded foam portion forms a foam frame to maintain the structural integrity of the bra with or without the underwire. The foam portion widens under the arm to move the breast tissue forward to enhance cleavage or prevent the breast tissue from sliding sideways under the arm. Preferably, the molded foam portion used with the adjustable bra of the present invention is made of foam, plastic, polyester or other suitable materials.

Figure 21:
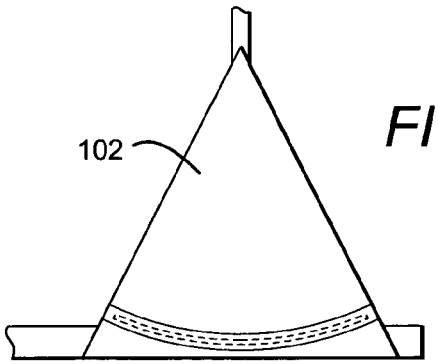
FIG. 21 is a third embodiment of a cup portion of the adjustable bra of the present invention showing a triangle cup.

The adjustable bra of the present invention may also comprise different bra cup shapes. FIG. 19 is a first embodiment of a cup portion of the adjustable bra of the present invention showing a full cup 98. FIG. 20 is a second embodiment of a cup portion of the adjustable bra of the present invention showing a demi cup 100. FIG. 21 is a third embodiment of a cup portion of the adjustable bra of the present invention showing a triangle cup 102.

Figure 22:
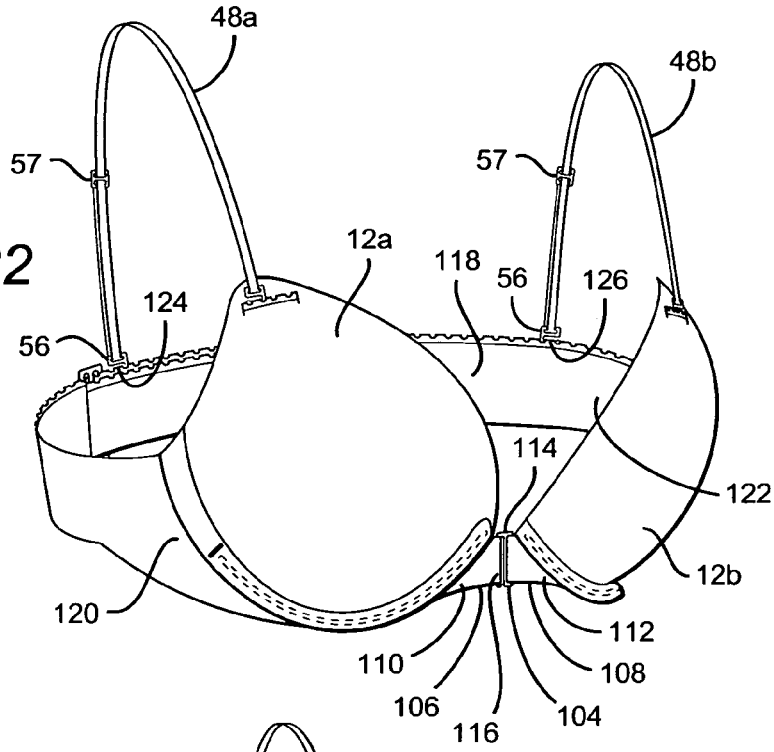
FIG. 22 is a front perspective view of a fourth exemplary embodiment of the adjustable bra of the present invention showing a front closure rather than a back closure.

Moreover, the adjustable bra of the present invention may also comprise multiple front and back closure configurations. FIG. 22 is the adjustable bra of FIG. 1 with a detachable coupling front closure rather than a back closure. Thus, instead of closing in the back, the bra closes in the front. In this alternative embodiment, as shown in FIG. 22, the adjustable bra comprises first and second bra cups having a detachable coupling 104 between the bra cups 12*a*, 12*b*. The detachable coupling 104 comprises a first front band 106 and a second front band 108. Preferably, the first and second front bands are made of woven or tricot knit fabric, foam, cotton, silk, polyester, microfiber, lycra, nylon, spandex, lace, satin or other suitable materials. The first front band 106 has a first end 110 coupled to the inner side portion 18 of the first bra cup 12*a*. The second front band 108 has a first end 112 coupled to the inner side portion 18 of the second bra cup 12*b*. The first front band 106 has a front closure element 114, and the second front band 108 has a front closure receiving element 116. However, the closure may be reversed, and the second front band may have the front closure element and the first front band may have the front closure receiving element. When the front closure element 114 is coupled to the front closure receiving element 116, the first and second bra cups are connected. Preferably, the front closure element may comprise hooks, snaps, clasps, clamps, buttons, rings, clips, ties, zippers, or other suitable front closure elements. Preferably, the front closure receiving element may comprise hook receiving elements, snap receiving elements, clasp receiving elements, buttonholes, ring receiving elements, clip receiving elements, ties, zippers, or other suitable front closure receiving elements. Preferably, the front closure element and front closure receiving element are made of plastic, metal, rubber or other suitable materials. The adjustable bra of this embodiment further comprises an adjustable back band 118 having a first end 120 attached to the first bra cup 12*a* and having a second end 122 attached to the second bra cup 12*b*. The first detachable shoulder strap 48*a* has a first end 50 connected to the first bra cup 12*a* and has a second end 52 with a back shoulder strap fastener 56 connected to a first portion 124 of the back band 118, and the second detachable shoulder strap 48*b* has a first end 50 connected to the second bra cup 12*b* and has a second end 52 with a back shoulder strap fastener 56 connected to a second portion 126 of the back band 118. The plurality of shoulder strap fastener receiving elements 58 is incorporated along an entire length of the back band 118, such that the shoulder strap fastener receiving elements 58 are adapted to receive and attach the first and second shoulder straps 48*a*, 48*b* anywhere along the entire length of the back band 118, including attachment to both a single layer back band and to a double layer back band, to enable a wearer to adjust the fit and comfort of the bra to a wearer's breast size and dimension. This alternative embodiment with the adjustable bra having a front closure can be used with any of the embodiments of the shoulder strap fastener receiving elements, such as the loop trim with side openings, the loop trim with front openings, the ridged trim, or other suitable shoulder strap fastener receiving elements. In addition, this alternative embodiment with the adjustable bra having a front closure can be used with any of the embodiments of the front and back shoulder strap fasteners, such as the double hook element, the clasp element, the clamp element, or other suitable front and back shoulder strap fasteners.

Figure 23:
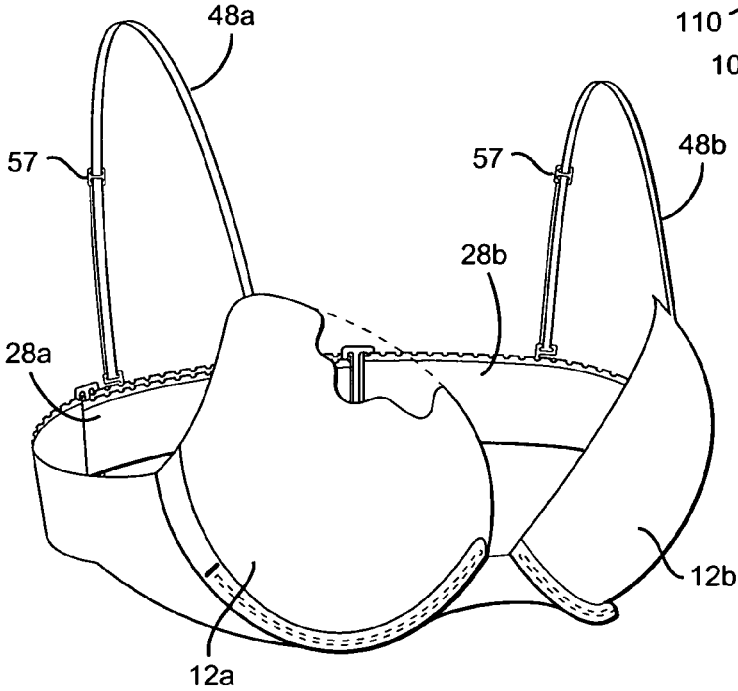
FIG. 23 is the adjustable bra of FIG. 1 having only back shoulder strap fasteners.
Figure 24:
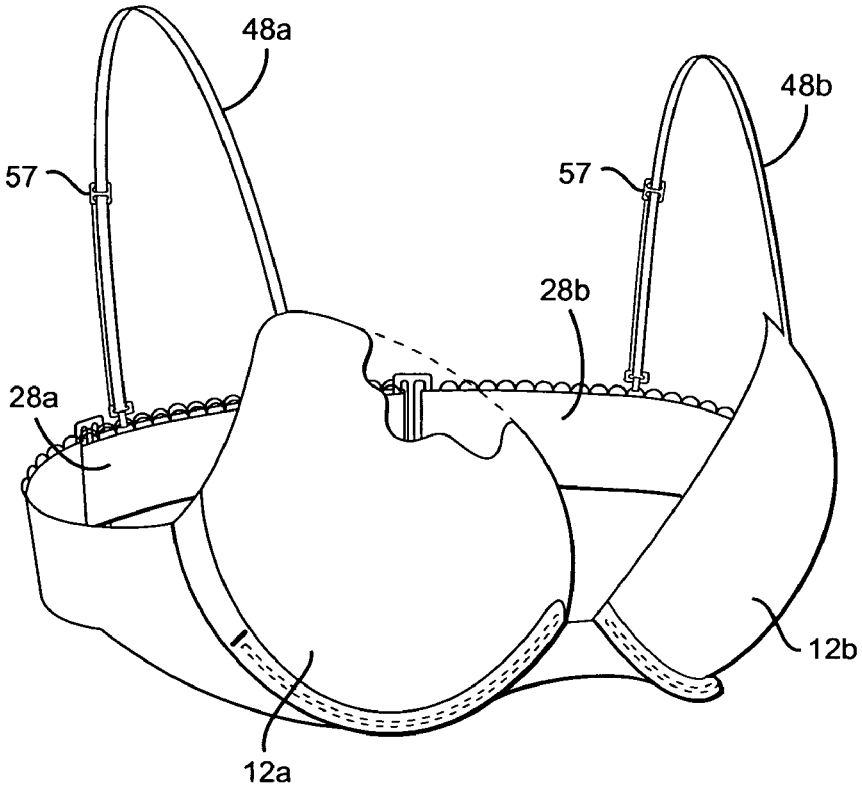
FIG. 24 is the adjustable bra of FIG. 7 having only back shoulder strap fasteners; and, FIG. 25 is the adjustable bra of FIG. 12 having only back shoulder strap fasteners.
Figure 25:
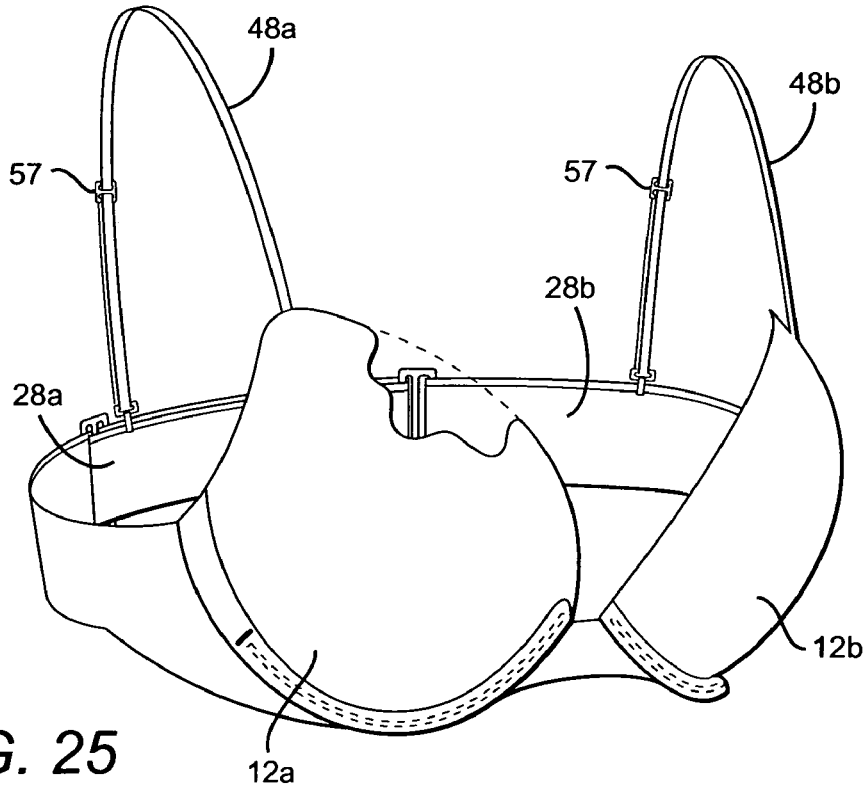

In yet another embodiment, the adjustable bra of the present invention can be used with shoulder straps that are detachable from the back only and are not detachable from the front and that use only back shoulder strap fasteners. FIG. 23 is the adjustable bra of FIG. 1 having only back shoulder strap fasteners where the shoulder strap fasteners are in the form of double hook elements. FIG. 24 is the adjustable bra of FIG. 7 having only back shoulder strap fasteners where the shoulder strap fasteners have clasp elements. FIG. 25 is the adjustable bra of FIG. 12 having only back shoulder strap fasteners where the shoulder strap fasteners have clamp elements.

In addition, the adjustable bra of the present invention may include a pocket (not shown) in one or both bra cups for insertion of padding or prosthetic devices.

Although the present invention has been described with reference to certain preferred versions thereof, other versions of the invention are possible. In compliance with the statute, the invention described herein has been described in language more or less specific as to structural features. It should be understood, however, that the invention is not limited to the embodiments described herein or to specific features shown, since the means and construction shown, is comprised only of the preferred embodiments for putting the invention into effect. It is also understood that the phraseology and terminology employed herein are for the purpose of description and should not be regarded as limiting.

What is claimed is:

1. An adjustable bra comprising:

first and second bra cups connected together, wherein the first and second bra cups each include an underwire element adapted to fit within a lower portion of each of the first and second bra cups;

a first adjustable double layer back band having a first end connected to the first bra cup and having a second free end, and a second back band having a first end connected to the second bra cup and having a second free end, wherein the second free end of the first back band is detachably connected to the second free end of the second back band;

at least one first detachable shoulder strap having a first end connected to the first bra cup and having a second end connected to the first back band, and at least one second detachable shoulder strap having a first end connected to the second bra cup and having a second end connected to the second back band; and, a plurality of shoulder strap fastener receiving elements incorporated along an entire length of the first and second back bands, wherein the shoulder strap fastener receiving elements are adapted to receive and attach the first and second shoulder straps anywhere along the entire length of the first and second back bands, including attachment to both a single layer back band and to a double layer back band, to enable a wearer to adjust the fit and comfort of the bra to a wearer's breast size and dimension.

2. The bra of claim 1 wherein the underwire element has a first end and a second end, such that the first end is adjacent an interior inner side of each bra cup and the second end is adjacent an opening in the lower portion of each bra cup, and further wherein the underwire may be removed through the opening in each bra cup, and further wherein the underwire is of a length that is approximately half that of a standard bra underwire.

3. The bra of claim 1 further comprising front and back shoulder strap fasteners, wherein the front shoulder strap fasteners connect the first ends of the shoulder straps to the respective bra cups and the back shoulder strap fasteners connect the second ends of the shoulder straps to the respective back bands.

4. The bra of claim 3 wherein the front and back shoulder strap fasteners comprise any one of the group of hook elements, clasp elements, and clamp elements.

5. The bra of claim 1 wherein the plurality of shoulder strap fastener receiving elements comprises a loop trim with side openings.

6. The bra of claim 1 wherein the plurality of shoulder strap fastener receiving elements comprises a loop trim with front openings.

7. The bra of claim 1 wherein the plurality of shoulder strap fastener receiving elements comprises a ridged trim.

8. An adjustable bra comprising:

first and second bra cups having a detachable coupling between the bra cups, wherein the first and second bra cups each include an underwire element adapted to fit within a lower portion of each of the first and second bra cups;

an adjustable back band having a double layer portion and having a first end attached to the first bra cup and having a second end attached to the second bra cup;

at least one first detachable shoulder strap having a first end connected to the first bra cup and having a second end connected to a first portion of the back band, and at least one second detachable shoulder strap having a first end connected to the second bra cup and having a second end connected to a second portion of the back band; and, a plurality of shoulder strap fastener receiving elements incorporated along an entire length of the back band, wherein the shoulder strap fastener receiving elements are adapted to receive and attach the first and second shoulder straps anywhere along the entire length of the back band, including attachment to both a single layer back band and to a double layer back band, to enable a wearer to adjust the fit and comfort of the bra to a wearer's breast size and dimension.

9. The bra of claim 8 wherein the underwire element has a first end and a second end, such that the first end is adjacent an interior inner side of each bra cup and the second end is adjacent an opening in the lower portion of each bra cup, and further wherein the underwire may be removed through the opening in each bra cup, and further wherein the underwire is of a length that is approximately half that of a standard bra underwire.

10. The bra of claim 8 further comprising front and back shoulder strap fasteners, wherein the front shoulder strap fasteners connect the first ends of the shoulder straps to the respective bra cups and the back shoulder strap fasteners connect the second ends of the shoulder straps to the back band.

11. The bra of claim 10 wherein the front and back shoulder strap fasteners comprise any one of the group of double hook elements, clasp elements, and clamp elements.

12. The bra of claim 8 wherein the plurality of shoulder strap fastener receiving elements comprises a loop trim with side openings.

13. The bra of claim 8 wherein the plurality of shoulder strap fastener receiving elements comprises a loop trim with front openings.

14. The bra of claim 8 wherein the plurality of shoulder strap fastener receiving elements comprises a ridged trim.

15. An adjustable bra comprising:

first and second bra cups connected together, wherein the first and second bra cups each include an underwire element adapted to fit within a lower portion of each of the first and second bra cups;

a first adjustable double layer back band having a first end connected to the first bra cup and having a second free end, and a second back band having a first end connected to the second bra cup and having a second free end, wherein the second free end of the first back band is detachably connected to the second free end of the second back band;

at least one first shoulder strap having a first undetachable end connected to the first bra cup and having a second detachable end connected to the first back band, and at least one second shoulder strap having a first undetachable end connected to the second bra cup and having a second detachable end connected to the second back band; and, a plurality of shoulder strap fastener receiving elements incorporated along an entire length of the first and second back bands, wherein the shoulder strap fastener receiving elements are adapted to receive and attach the first and second shoulder straps anywhere along the entire length of the first and second back bands, including attachment to both a single layer back band and to a double layer back band, to enable a wearer to adjust the fit and comfort of the bra to a wearer's breast size and dimension.

16. The bra of claim 15 wherein the underwire element has a first end and a second end, such that the first end is adjacent an interior inner side of each bra cup and the second end is adjacent an opening in the lower portion of each bra cup, and further wherein the underwire may be removed through the opening in each bra cup, and further wherein the underwire is of a length that is approximately half that of a standard bra underwire.

17. The bra of claim 16 further comprising back shoulder strap fasteners, wherein the back shoulder strap fasteners connect the detachable ends of the shoulder straps to the back band, and further wherein the back shoulder strap fasteners comprise any one of the group of double hook elements, clasp elements, and clamp elements.

18. An adjustable bra comprising:

first and second bra cups having a detachable coupling between the bra cups, wherein the first and second bra cups each include an underwire element adapted to fit within a lower portion of each of the first and second bra cups;

an adjustable back band having a double layer portion and having a first end attached to the first bra cup and having a second end attached to the second bra cup;

at least one first shoulder strap having a first undetachable end connected to the first bra cup and having a second detachable end connected to a first portion of the back band, and at least one second shoulder strap having a first undetachable end connected to the second bra cup and having a second detachable end connected to a second portion of the back band; and, a plurality of shoulder strap fastener receiving elements incorporated along an entire length of the back band, wherein the shoulder strap fastener receiving elements are adapted to receive and attach the first and second shoulder straps anywhere along the entire length of the back band, including attachment to both a single layer back band and to a double layer back band, to enable a wearer to adjust the fit and comfort of the bra to a wearer's breast size and dimension.

19. The bra of claim 18 wherein the underwire element has a first end and a second end, such that the first end is adjacent an interior inner side of each bra cup and the second end is adjacent an opening in the lower portion of each bra cup, and further wherein the underwire may be removed through the opening in each bra cup, and further wherein the underwire is of a length that is approximately half that of a standard bra underwire.

20. The bra of claim 18 further comprising back shoulder strap fasteners, wherein the back shoulder strap fasteners connect the detachable ends of the shoulder straps to the back band, and further wherein the back shoulder strap fasteners comprise any one of the group of double hook elements, clasp elements, and clamp elements.

* * * * *